United States Patent [19]

Kinoshita

[11] 3,971,937

[45] July 27, 1976

[54] RADIOGRAPHY APPARATUS FOR FORMING AN ELECTROSTATIC LATENT IMAGE OF A BODY TO BE EXAMINED BY THE IONIZATION OF GAS

[75] Inventor: Koichi Kinoshita, Narashino, Japan

[73] Assignee: Kinoshita Laboratory, Tokyo, Japan

[22] Filed: Nov. 13, 1974

[21] Appl. No.: 523,519

[30] Foreign Application Priority Data

Nov. 14, 1973 Japan ..... 48-128058

[52] U.S. Cl. ..... 250/315 A

[51] Int. Cl.[2] ..... G03G 15/044

[58] Field of Search ..... 250/315, 315 A, 468, 250/469

[56] References Cited

UNITED STATES PATENTS 3,873,832 3/1975 Eseke et al. ..... 250/315 A

*Primary Examiner*—Davis L. Willis

*Attorney, Agent, or Firm*—Fitzpatrick, Cella, Harper & Scinto

[57] ABSTRACT

A radiography apparatus in which gas is directly or indirectly ionized by ionizing radiation to form on an insulating film an electrostatic latent image of a body to be examined is provided with at least two gas chambers. In one of the chambers, an anode and a cathode are disposed in opposed relationship, and gas at a predetermined pressure fills the space between the two electrodes. The insulating film is disposed on the surface of one of the electrodes. The film with an electrostatic image formed thereon is moved through the other gas chamber. This chamber is filled with such gas as dry air, the pressure of which gas is substantially in equilibrium relationship with the pressure of the ionizing gas.

14 Claims, 5 Drawing Figures

RADIOGRAPHY APPARATUS FOR FORMING AN ELECTROSTATIC LATENT IMAGE OF A BODY TO BE EXAMINED BY THE IONIZATION OF GAS

BACKGROUND OF THE INVENTION

1. Field of the Invention

This invention relates to improvements in a radiography apparatus which is provided with a gas chamber for enveloping therein gas ionizable by an ionizing radiation such as X-rays or $\gamma$-rays and forms an electrostatic image of a body to be examined.

2. Description of the Prior Art

Radiography apparatus provided with a gas chamber for enveloping therein ionizing gas is known from, for example, published German Pat. No. 1,497,093 specification (hereinafter referred to as DAS No. 1,497,093) or open German Pat. No. 2,258,364 specification (hereinafter referred to DOS No. 2,258,364). The apparatus disclosed in DOS No. 2,258,368 is provided with a high pressure gas chamber. In the high pressure gas chamber, an anode and a cathode to which is applied a DC voltage are disposed in a predteremined spaced-apart relationship. Ionizing gas, for example, a mixture of xenon and a small amount of quenching gas is enveloped in the gas chamber at a pressure above the atmospheric level. An insulating film is disposed on the anode in opposed relationship with the cathode. The radiation passed through a body to be examined ionizes the gas in the chamber. By the action of the electric field, positive ions are acceleratedly attracted toward the cathode while electrons are acceleratedly attracted toward the cathode while electrons are acceleratedly attracted toward the anode, thereby further producing a number of secondary electrons. As a result, these electrons are deposited onto the insulating film on the anode, thus forming an image pattern. In this manner, an electrostatic latent image of the body to be examined is formed. The apparatus disclosed in DAS No. 1,497,093 is substantially similar in construction to that disclosed in DOS No. 2,258,364, excepting that the gas in the gas chamber is at a low pressure and that electrons are bombarded from a heavy metal such as lead or the like.

In these apparatuses of the prior art, the electrostatic latent image formed in taken out of the gas chamber and developed by the use of common electrophotographic developing method. By that time, the ionizing gas filling the gas chamber has already been discharged. Likewise, the gas chamber is evacuated when the film is placed thereinto.

In this way, gas is supplied to and discharged from the gas chamber at every picture-taking cycle, so that operation of the apparatus is cumbersome and difficult and accordingly limited in rapid continuous picture-taking. Further, removal of the film with the gas chamber open results in leakage, and accordingly loss, of the gas and in some cases, the leaked gas may adversely affect the human bodies or the like, and in addition, such loss of the gas would be particularly expensive if the gas were xenon or the like.

SUMMARY OF THE INVENTION

It is an object of the present invention to provide a radiography apparatus in which gas enveloped in a gas chamber is ionized to form an electrostatic latent image of a body to be examined and which enables rapid continuous picture-taking to be accomplished.

It is another object of the present invention to provide such a radiography apparatus which is simple to operate.

It is still another object of the present invention to provide such a radiography apparatus which minimizes gas leakage from the gas chamber to protect the environment against pollution.

The apparatus according to the present invention is equipped with a gas chamber for the electrostatic latent image formation in which ionizing gas is enveloped and which is provided with a cathode and an anode, and additional one or more gas chambers. The gas chambers are successively communicated with one another in an air-tight manner to the atmosphere. The pressure of the gas in the gas chamber for the electrostatic latent image formation and the pressure of the gas in the gas chamber which is directly communicated with the first-named gas chamber are maintained in a good equilibrium relationship. The invention will become more fully apparent from the following detailed description thereof taken in conjunction with the accompanying drawings.

DESCRIPTION OF THE PREFERRED EMBODIMENTS

Figure 1:
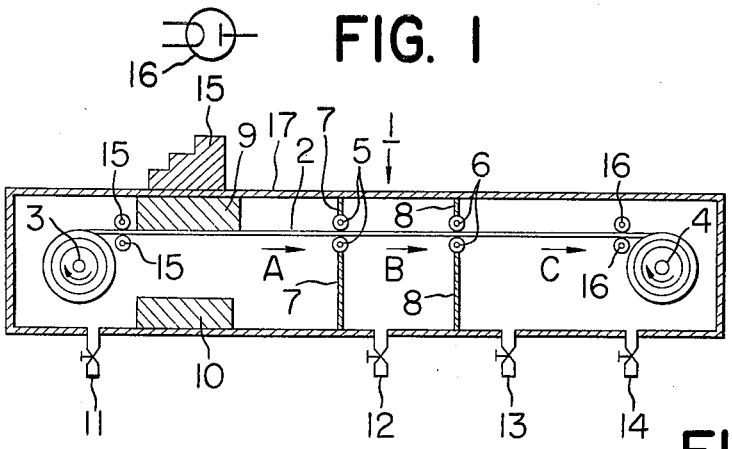
FIG. 1 schematically illustrates an embodiment of the apparatus according to the present invention.

Referring to FIG. 1, the apparatus according to the present invention comprises three gas chambers A, B and C. The gas chambers A, B and C are formed by dividing the interior of a hermetically sealed box 1 by partition panels 7 and 8 secured to the box 1, the box 1 being resistant to the gas pressure in each chamber. Pairs of closely spaced rollers 5,5 and 6,6 are rotatably mounted on the partition panels 7 and 8, respectively. These rollers 5 and 6 define a film passage. Thus, the chambers A, B and C are communicated with one another through these rollers 5 and 6.

The gas chamber A is the chamber for forming an electrostatic latent image on an insulating film 2. Planar electrodes 9 and 10 are disposed within the chamber A in insulated relationship with the box frame 1 and in opposed relationship with each other. The electrode 9 (toward which there is disposed a source of radiation such as X-rays, $\gamma$-rays or the like) and the wall portion 17 of the box 1 on which the electrode 9 is disposed are formed of either light metal having a high transmittivity to the radiation or an alloy of such metal. In some instance, portions of the box frame may be used also as the electrodes 9 and 10. The electrode 9 should desirably be the anode for an image of good quality to be formed. A high voltage may be applied from an extraneous voltage source (not shown) to the two electrodes 9 and 10 to such an extent that no dielectric breakdown occurs. A mixture of xenon or like gas well absorbing the radiation and ionizable thereby and a small amount of quenching gas such as methane or the like is supplied from a pump (not shown) provided with a pressure regulator, through a gas cock 11, into the chamber A between the two electrodes, and enveloped therein. Throughout the operation of the apparatus or at least during picture-taking operation, the ionizing gas filling the chamber A is constantly maintained at a predetermined pressure above the atmospheric pressure by the gas supply pump. The pressure of the ionizing gases and the distance between the electrodes 9 and 10 are correlated as described in aforesaid DOS No. 2,258,364. (If the distance between the electrodes 9 and 10 is 10 mm, the gas pressure in the chamber A should preferably be of the order of 5 atmospheric pressures.) In FIG. 1, the insulating film 2 on which electrostatic latent image are to be formed is in the form of rolled film. The film 2 is rotatably mounted on the outer frame of the chamber A, and may be fed at a predetermined rate for each picture-taking cycle by a roll 3 driven from a motor (not shown) located outside the chamber. A pair of rollers 15, 15 rotatably mounted on the outer frame of the chamber A serve to guide the film 2 such that the film 2 when fed lies in a predetermined position in the space within the chamber, namely, lies in proximity to the electrode 9. The film 2 is brought into intimate contact with the surface of the electrode 9 at least during picture-taking. (Alternatively, the film 2 may of course be brought into intimate contact with the surface of the electrode 10.)

When a body to be examined 15 disposed in a predetermined space adjacent the electrode 9 is irradiated with the radiation from the source of radiation such as X-rays or the like, the radiation passes through the body 15 and the box wall portion 17 corresponding to the electrode 9 and further through the electrode 9 to ionize the ionizing gas present between the electrodes 9 and 10. Positive ions and electrons thus produced are accelerated in their respective directions under the action of the electric field produced by the electrodes 9 and 10 and impinge upon gas atoms to further produce a number of secondary electrons. As a result, an electrostatic latent image of the body 15 is formed on the insulating film 2 disposed on the surface of the electrode 9.

The film 2 with an electrostatic latent image so formed thereon is then moved along the film passage or between the rollers 5 and 5 into the gas chamber B.

The rollers 5 and other rollers 6, 15, 16, which make contact with the film 2, are all formed of an insulating material of high resistance, such as ceramics, covered with rubber coating, in order to prevent leakage of electrostatic charges on the film 2 and/or prevent the electrostatic image on the film from being disturbed by frictional electricity. These rollers 5, 6, 15, 16 are smoothly rotated in synchronism with the velocity of the film movement. If required, means for rotatively driving these rollers may be provided. The rollers 5 (and 6) are disposed so as to make substantially pressure-contact with the film 2 and should desirably avoid leaving any appreciable clearance with respect to the film 2. Likewise, any clearance is avoided in the junctions between the box frame 1 and the partition panels 7,8, and the clearances between the rollers 5,6 and the partition panels 7,8 are very much limited. In short, the communication between the chambers A and B and the communication between the chambers B and C, which will further be described, are very much restricted.

A charge of gas, such as dry air, which is less ionizable than the gas in the chamber A and will not adversely affect the electrostatic latent image formed on the film 2, is supplied from an unshown pump provided with a pressure regulator, through a cock 12, into the chamber B. The pressure of the gas filling the chamber B is regulated by the gas supply pump such that it is in equilibrium relationship with the gas pressure in the chamber A. More specifically, the gas pressure in the chamber B is regulated to a level equal to or at least slightly lower than the gas pressure in the chamber A. It is not desirable that the gas pressure in the chamber B be higher than that in the chamber A. By this, leakage, if any, of the ionizing gas from the chamber A into the chamber B may be minimized and thus, the pressure variation in the chamber A is substantially null and in addition, mixing of the gas (e.g. dry air) in the chamber B with the gas in the chamber A may be avoided. Thus, the gas in the chamber A may be maintained at a predetermined composition and at a predetermined pressure.

After moved to the chamber B, the film 2 is further moved through the film passage between the rollers 6 and 6 and into the chamber C. The chamber C, as previously described, is isolated from the chamber B by the partition panel 8, and communicated with the chamber B by the rollers 6. In the chamber C, there is provided a roll 4 for taking up the rolled film 2. The roll 4 is driven to rotate in synchronism with the roll 3 by a motor (not shown) located outside the chamber. The rollers 16 are rotatably mounted on the box frame 1 and serve to guide the movement of the film 2. Although not shown, conventional electrophotographic developing-fixing means using the powder cloud technique or the like is disposed within the chamber C. The electrostatic latent image on the film 2 is developed and fixed before the film 2 is taken up onto the roll 4. Alternatively, the development may be done by removing the lid of the chamber C, taking out the film 2 with the electrostatic image formed thereon from the chamber and bringing the film to the developing process.

A charge of gas, such as dry air, which is less ionizable and will not adversely affect the electrostatic image, is supplied from an unshown pump provided with a pressure regulator, through a cock 13, into the gas chamber C. During the operation of the apparatus, the gas pressure in the chamber C is regulated by the pump such that it is substantially in equilibrium relationship with the gas pressure in the chamber B. More specifically, the gas pressure in the chamber C is regulated to a level equal to or slightly lower than that in the chamber B. However, the equilibrium relationship between the chambers B and C need not be so exact as that between the chambers A and B. The reason is that any leakage of the gas from the chamber B to the chamber C will be unobjectionable because the gases in these chambers are identical, i.e. cheap dry air, for example, while any leakage of the gas from the chamber C to the chamber B will offer no inconvenience because the gas chamber B is not concerned with the electrostatic image formation. Further, a little pressure variation in the chambers B and C is negligible because neither of these chambers is directed to the electrostatic image formation. What is important is to maintain a predetermined pressure in the chamber A and it is for this purpose that the pressure in the chamber B is in equilibrium relationship with that in the chamber A, and the function of the chamber C is to facilitate the regulation of said equilibrium relationship. Therefore, if the pressure in the chamber A and the pressure in the chamber B could be maintained in sufficient equilibrium relationship therebetween, it would not be necessary to suitably regulate the pressure in the chamber C and it would suffice to develop and/or contain the film in the conventional manner without the pressure in the chamber C being taken into consideration. This is because the function of the chamber C is to minimize the pressure difference between it and its adjacent chamber B.

Thus, the object of the present invention may also be achieved by using only the two chambers A and B and by maintaining equilibrium relationship between the pressures in these two chambers. In such case, the chamber C need not be air-tight to the atmosphere.

After the film 2 is developed and fixed by the developing-fixing means in the chamber C and taken up on the roll 4, the chamber C is evacuated through the cock 14 to reduce the pressure therein to the atmospheric pressure, and then the lid of this chamber is opened to remove the film 2 out of the chamber. In case where the film 2 is developed outside the chamber C, this chamber is likewise evacuated.

Figure 2:
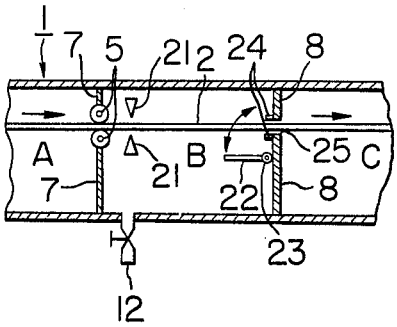
FIG. 2 is a fragmentary view schematically illustrating a modified form of the apparatus shown in FIG. 1 and applicable as an apparatus provided with a high pressure gas chamber.

FIG. 2 shows a device for more effectively preventing leakage of the gas from the chamber B into the chamber C and the resulting pressure variation in the chamber B when the gas such as dry air or the like in the chamber C is discharged through the cock 14 in FIG. 1. On that side of the partition panel 8 between the chambers B and C which is adjacent the chamber B, a vertically pivotable valve plate 22 is mounted by means of a shaft 23 rotatable upon extraneous actuation. The film passage portion of the partition panel 8 is formed with a thin gap 25 sufficient to provide a film passage which will permit the film to pass therethrough without making contact with the partition panel. The film 2 may pass through such gap 25 into the chamber C. As shown in FIG. 2, a valve plate contact member 24 formed of rubber or like material is secured to the partition panel 8 at the ends of the gap 25. Of course, the combination of the gap 25 and the valve plate contact member 24 may be replaced by a pair of rollers 6 as shown in FIG. 1. The film 2 moved from the chamber A may be cut into a predetermined length by a cutter 21 disposed in the chamber B and actuated in synchronism with the roll 3. The location at which the cutter is disposed is selected such that the cutter does not interfere with the opening-closing of the valve plate 21 or otherwise impede the same valve plate. The predetermined length of the film 2 cut off by the cutter 21 may be passed through the gap 25 and drawn into the chamber C by a plurality of rollers (not shown) provided in that chamber. The electrostatic latent image formed on the film 2 may be developed in the chamber C in the same manner as previously described, or alternatively may be removed outwardly to an extraneous developing process for development. When the trailing end of the film 2 has passed through the gap 25 and when the film is to be removed out of the chamber C, the shaft 23 is rotated to pivot the valve plate 22 into intimate contact with the valve plate contact member 24. When the pressure in the chamber C is reduced, the valve plate 22 is more intensely urged against the valve plate contact member, thereby sealing the gap 25. This prevents any leakage of the gas from the chamber B into the chamber C and accordingly, any pressure variation in the chamber B.

By mounting valve means in each film passage between adjacent chambers, the gas pressure in each chamber can be maintained stably at a constant level.

Figure 3:
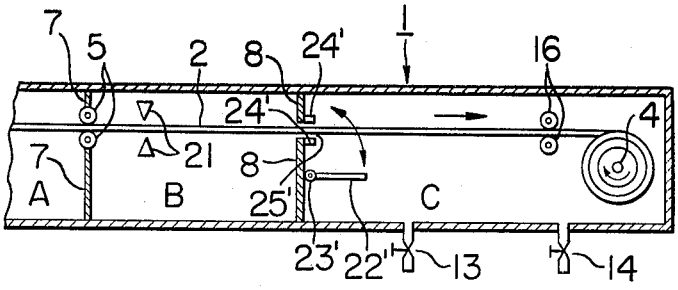
FIG. 3 is a fragmentary view schematically illustrating another modified form of the apparatus shown in FIG. 1 and applicable as an apparatus provided with a low pressure gas chamber.

The apparatus shown in FIG. 2 is an embodiment in which the gas pressure in the gas chamber A and thus in the gas chamber B is above the atmospheric pressure, but if the gas pressure in the chamber A and thus in the chamber B is below the atmospheric pressure, a valve plate 22' may be provided on that side of the partition panel 8 which is adjacent the chamber C, as shown in FIG. 3. Except the resultant changes in position of the associated members, the basic construction of the valve means shown in FIG. 3 is similar to that shown in FIG. 2. When the pressure in the chamber C restores the atmospheric pressure, the valve plate 22' will come into sealing contact with the valve plate contact member 24' to thereby stably maintain the gas pressure in the chambers B and A at a predetermined low pressure.

To ensure electrostatic latent images of good quality to be formed, the pressure of the ionizing gas in the gas chamber A should desirably be maintained stably at a predetermined level. From this, it follows that any member which might impede the pressure regulation or might result in pressure variation should conveniently be absent at least in the chamber A so as to ensure accuracy or the pressure regulation.

Figure 4:
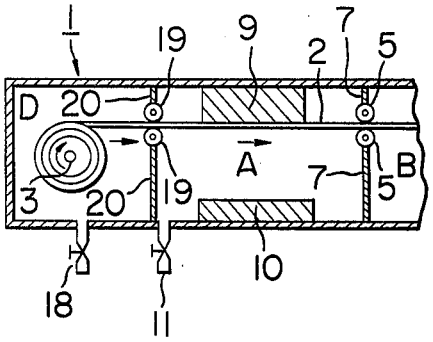
FIG. 4 schematically illustrates another embodiment of the apparatus according to the present invention.

In FIG. 1, the film supply roll 3 is shown to lie in the chamber A, but alternatively, as shown in FIG. 4, a chamber D separated from the chamber A by a partition panel 20 sealingly secured to the box frame 1 may be communicated with the chamber A through rollers 19 rotatably mounted in a portion of the partition panel 20 so as to supply the film from the chamber D to the chamber A, with a good result.

A charge of less ionizable gas such as dry air or the like is supplied from a pump (not shown) provided with a pressure regulator, through a cock 18, into the chamber D. The pressure of such gas is regulated so as to be in equilibrium with the pressure in the chamber A to thereby prevent gas leakage from the chamber A into the chamber D or vice versa. Preferably, the pressure in the chamber D is equal to or slightly lower than the pressure in the chamber A.

Figure 5:
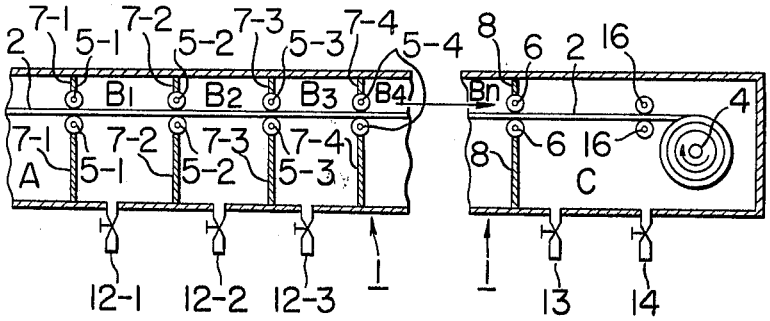
FIG. 5 schematically illustrates still another embodiment of the apparatus according to the present invention.

It is in the gas chamber A that electrostatic image formation on the insulating film 2 occurs. On the other hand, the electrostatic image is developed in the gas chamber C or the film 2 is removed out of that chamber so as to be subjected to various treatments succeeding to the formation of electrostatic image. Therefore, the chamber C tends to present a great pressure variation, which in turn tends to cause a pressure variation in the chamber A. In FIG. 5, the gas chamber B described hitherto is divided into a plurality of chambers $B_1$, $B_2$ . . . $B_n$. These chambers $B_1$ to $B_n$ are provided by dividing the interior of the box frame 1 by partition panels 7-1, 7-2 . . . **7-*n* and 8 sealingly secured to the box frame 1, and the chambers A, C and $B_1$, $B_2$ . . . $B_n$ are separated from one another. Pairs of rollers 5-1, 5-2 . . . 5-*n* and 6, similar to those described above, are provided in a portion of the respective partition panels 7-1, 7-2 . . . 7-*n* and 8**, and these rollers define film passage which provide communication between adjacent chambers. These film passages may be in the form of the slit-like openings as previously described, and may further be provided with valve means.

The chambers $B_1, B_2 \ldots B_n$ are supplied with gas such as dry air or the like by respective pumps provided with pressure regulators, through respective cocks 12-1, 12-2 . . . **12-*n***. The gas pressures in the chambers $B_1, B_2 \ldots B_n$ are regulated by the respective gas supply pumps in a manner which will be described below. The gas pressure in the chamber $B_1$ and that in the chamber A are regulated so as to be in sufficiently good equilibrium relationship. The gas pressure in the chamber $B_1$ and that in the chamber $B_2$ are also regulated so as to be in equilibrium relationship. However, the equilibrium relationship between the gas pressures in the chambers $B_1$ and $B_2$ need not be so good so that between the gas pressure in the chambers A and $B_1$. In such a manner, the subsequent chambers $B_3$ to $B_n$ are filled with gas. When the ionizing gas pressure in the chamber A is above the atmospheric pressure, the pressure in each of the chambers $B_2$ to $B_n$ may be reduced to a little below the pressure level in its preceding chamber, whereby the apparatus is satisfactorily operable even if the gas pressure in the chamber C is considerably low. (When the gas pressure in the chamber A is below the atmospheric pressure, the pressure relationships between the chambers $B_2, B_3 \ldots B_n$ may be converse to what has been described just above.) The pressure variation in the chamber C is alleviated by the plurality of chambers $B_1, B_2 \ldots B_n$, thus resulting in no pressure variation in the chamber A. A greater number of chambers $B_1, B_2 \ldots B_n$ would enable the apparatus to operate well with the chamber C being at the atmospheric pressure from the beginning.

The invention has been described with the respect chiefly to the embodiments wherein ionizing gas is enveloped in the gas chamber A at a pressure above the atmospheric pressure, but it will be apparent that the invention is applicable to the apparatus as shown in DAS No. 1,497,093 wherein ionizing gas is enveloped in the chamber A at a pressure below the atmospheric pressure or to the apparatus wherein ionizing gas is enveloped at a pressure equal to the atmospheric pressure. In the case of the apparatus wherein ionizing gas is enveloped in the chamber A at a pressure below the atmospheric pressure, the electrode 10 (or 9) facing the film 2 is one formed of a heavy metal such as lead which can bombard electrons when irradiated with ionizing radiation.

The embodiments of the present invention have been described with respect to the cases where the film 2 is in the form of roll, whereas sheets of film are also usable. In such a case, the film supply roll 3 should be replaced by a film feeder device for feeding sheets of insulating film one by one toward the electrode 9 in synchronism with the operation of the radiation source 16. Also, the roll 4 should be replaced by a device for containing oncoming sheets of film in superposed relationship therein. Means for transporting sheets of film with electrostatic images formed thereon from the chamber A to the chamber C may be a highly insulative belt conveyor, for example.

Further, an image developed on the insulating film may be transferred to other film or paper, instead of being fixed directly on the insulating film. In this case, the insulating film is reciprocated between the chambers A and C. In the chamber c, there are additionally provided transfer paper supply means and image transfer means. After the insulating film has an electrostatic image formed thereon in the chamber A, powder is blown against the insulating film in the chamber C so that the film adsorbs the powder in an image pattern in accordance with the quantity of charges. Paper is then urged against the film. Of course, such image transfer process may also be effected outside the apparatus.

Furthermore, each chamber may be formed as a cassette and these cassettes may be assembled together, as required. For example, the chambers D and C may be of the cassette type. These chamber cassettes are coupled together by means of packing, while the chambers A and D and the chambers B and C are respectively made air-tight to the atmosphere and communicated by a film passage. The chambers D and C so formed as individual cassettes would facilitate the supply and removal of the film.

It should be understood that other various modifications may be made in the apparatus of the present invention without departing from the spirit of the invention as defined in the appended claims.

What is claimed is:

1. A radiography apparatus for foming an electrostatic latent image of a body to be examined by the ionization of gas, comprising:

a first gas chamber having therein electrodes opposed in a predetermined spaced-apart relationship, the electric field produced by said electrodes being filled with ionizing gas at a predetermined pressure, an insulating film being disposed adjacent one of said electrodes;

a second gas chamber filled with gas, at a pressure which is substantially in equilibrium relationship with the pressure of the ionizing gas in said first gas chamber, said gas in said second chamber being less ionizable than said gas in said first gas chamber;

a film passage through which said insulating film moves between said first and said second chamber, said film passage providing a connection between said first and said second chamber in an air-tight manner with respect to the atmosphere; and means for transporting said insulating film, said means locating said film in proximity to one of said electrodes in said first gas chamber and transporting said film through said film passage from one of said chambers to the other.

2. A radiography apparatus according to claim 1, wherein the pressure of the ionizing gas in said first gas chamber is above atmospheric pressure.

3. A radiography apparatus according to claim 2, wherein the pressure of the gas in said second chamber is less than that of the gas in said first chamber.

4. A radiography apparatus according to claim 1, wherein the pressure of the ionizing gas in said first gas chamber is below atmospheric pressure.

5. A radiography apparatus according to claim 4, wherein the pressure of the gas in said second chamber is higher than that in said first chamber.

6. A radiography apparatus for forming an electrostatic latent image of a body to be examined by the ionization of gas, comprising:

a first gas chamber having therein electrodes opposed in a predetermined spaced-apart relationship, the electric field produced by said electrodes being filled with ionizing gases at a predetermined pressure, an insulating film disposed adjacent one of said electrodes;

a second gas chamber filled with gas, at pressure which is substantially in equilibrium relationship with the pressure of the ionizing gas in said first gas chamber, said gas in said second chamber being less ionizable than said gas in said first gas chamber;

a first film passage through which said insulating film moves between said first and said second chamber, said first film passage providing a connection between said first and said second chamber in an air-tight manner with respect to the atmosphere;

a third gas chamber filled with gas, said gas in said third chamber being less ionizable than said gas in said first gas chamber, and being in equilibrium relationship with the pressure of the gas in said second gas chamber, said third chamber having means for holding said insulating film with an electrostatic image formed thereon in said first gas chamber;

a second film passage through which said insulating film moves from said second gas chamber to said third gas chamber; and means for transporting said insulating film, said means locating said film in proximity to one of said electrodes in said first gas chamber and to transport said film through said first and second film passages successively into said first, second and third gas chambers.

7. A radiography apparatus according to claim 6, wherein the pressure of the gas in said first gas chamber is above atmospheric pressure and the pressure of the gas is said third gas chamber is below the pressure of the gas in said first gas chamber.

8. A radiography apparatus according to claim 6, wherein the pressure of the gas in said first gas chamber is below atmospheric pressure and the pressure of the gas in said third gas chamber is above the pressure of the gas in said first chamber.

9. A radiography apparatus according to claim 6, wherein said second gas chamber comprises a plurality of chambers each of which is filled with gas which is less ionizable than the gas in said first chamber, and successively communicated by a film passage through which said insulating film passes.

10. A radiography apparatus according to claim 9, wherein said plurality of chambers forming said second gas chamber are filled with gas at such pressures that the gas pressures in adjacent ones of said plurality of chambers are substantially in equilibrium relationship.

11. A radiography apparatus according to claim 9, wherein the pressure of the gas in said first gas chamber is above atmospheric pressure, and the pressures of the gas in said plurality of gas chambers forming said second gas chamber are successively lower than the pressure of the gas in said first gas chamber.

12. A radiography apparatus according to claim 9, wherein the pressure of said ionizing gas in said first gas chamber is below atmospheric pressure, and the pressures of the gas in said plurality of gas chambers forming said second gas chamber are successively higher than the pressure of the gas in said first gas chamber.

13. A radiography apparatus according to claim 6, further comprising:

a fourth gas chamber having means for supplying unexposed insulating film to said first gas chamber, said fourth chamber being filled with gas, at a pressure which is substantially in equilibrium relationship with the pressure of the gas in said first gas chamber, said gas in said fourth chamber being less ionizable than the gas in said first gas chamber; and a third film passage through which said insulating film moves from said fourth gas chamber to said first gas chamber, said third film passage providing a communication between said fourth gas chamber and said first gas chamber in an air-tight manner with respect to the atmosphere.

14. A radiography apparatus according to claim 6, further comprising means for developing an electrostatic image formed on said insulating film in said first gas chamber, said means being disposed in said third gas chamber.

* * * * *

UNITED STATES PATENT AND TRADEMARK OFFICE

CERTIFICATE OF CORRECTION

PATENT NO. : 3,971,937

DATED : July 27, 1976

INVENTOR(S) : KOICHI KINOSHITA

It is certified that error appears in the above-identified patent and that said Letters Patent are hereby corrected as shown below:

Column 1, line 20, change "2,258,368" to -- 2,258,364 --; lines 32 and 33, delete "while electrons are acceleratedly attracted toward the cathode".

Signed and Sealed this

Fourteenth Day of December 1976

[SEAL]

*Attest:*

RUTH C. MASON
*Attesting Officer*

C. MARSHALL DANN
*Commissioner of Patents and Trademarks*